US010654703B2

(12) United States Patent
Hecht et al.

(10) Patent No.: US 10,654,703 B2
(45) Date of Patent: May 19, 2020

(54) BEVERAGE DISPENSING APPARATUS WITH REMOTE DISPENSING OPERATIVE CONTROLS

(71) Applicant: Automatic Bar Controls, Inc., Vacaville, CA (US)

(72) Inventors: Thomas R. Hecht, Winters, CA (US); Richard A. Martindale, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 29 days.

(21) Appl. No.: 14/975,679

(22) Filed: Dec. 18, 2015

(65) Prior Publication Data

US 2016/0176696 A1 Jun. 23, 2016

Related U.S. Application Data

(60) Provisional application No. 62/094,898, filed on Dec. 19, 2014.

(51) Int. Cl.

| | |
|---|---|
| ***B67D 1/14*** | (2006.01) |
| ***B67D 1/00*** | (2006.01) |
| ***B67D 1/08*** | (2006.01) |

(52) U.S. Cl.

CPC ..... *B67D 1/1405* (2013.01); *B67D 1/0086* (2013.01); *B67D 1/0888* (2013.01); *B67D 2001/1483* (2013.01)

(58) Field of Classification Search

CPC ..... B67D 1/1405; B67D 1/0888; B67D 2001/1483; B67D 1/0044; B67D 1/0086; B67D 1/1293; B67D 1/0035

(Continued)

(56) References Cited

U.S. PATENT DOCUMENTS 3,216,445 A * 11/1965 Cornelius ..... B67D 1/1472 137/594
3,863,810 A * 2/1975 Hanson ..... B67D 1/0084 137/606

(Continued)

FOREIGN PATENT DOCUMENTS

JP 2006/264733 A2 10/2016

OTHER PUBLICATIONS

International Search Report and Written Opinion in PCT/US2015/066914, dated Apr. 7, 2016, 11 pages.

*Primary Examiner* — Vishal Pancholi
*Assistant Examiner* — Robert K Nichols, II
(74) *Attorney, Agent, or Firm* — Kilpatrick Townsend & Stockton LLP

(57) ABSTRACT

A beverage dispensing apparatus having a nozzle and multiple fluid lines in fluid communication with the nozzle where the beverage dispensing apparatus has a body with a plurality of apertures, a plurality of buttons, each protruding through a respective one of the apertures and configured to control a flow of fluid through a respective one of the multiple fluid lines, the plurality of buttons having at least one active dispensing button configured to mechanically dispense a fluid and at least one remote dispensing button, and a remote dispensing device located remotely from the body configured to regulate dispensing a fluid through one of the multiple fluid lines so that when the at least one remote button is depressed, the remote dispensing device dispenses a fluid through the fluid line.

5 Claims, 6 Drawing Sheets

(58) Field of Classification Search
USPC ..... 222/144.5, 145.1, 145.5
See application file for complete search history.

(56) References Cited

U.S. PATENT DOCUMENTS

| | | | | |
|---|---|---|---|---|
| 4,162,028 | A | 7/1979 | Reichenberger | |
| 4,986,449 | A * | 1/1991 | Valiyee | B67D 1/0084 137/606 |
| 6,390,662 | B1 * | 5/2002 | Henry | A21C 15/005 118/14 |
| 7,878,370 | B2 * | 2/2011 | Sevcik | B67D 1/0021 222/1 |
| 8,807,395 | B2 | 8/2014 | Schroeder et al. | |
| 2010/0163572 | A1 * | 7/2010 | Downham | B67D 1/0004 222/1 |
| 2011/0315711 | A1 * | 12/2011 | Hecht | A47J 31/52 222/129.1 |
| 2012/0055954 | A1 * | 3/2012 | Hecht | A47J 31/52 222/129.1 |
| 2012/0325855 | A1 | 12/2012 | Brown et al. | |
| 2013/0206793 | A1 * | 8/2013 | Minica | B67D 1/0085 222/129.1 |

* cited by examiner

BEVERAGE DISPENSING APPARATUS WITH REMOTE DISPENSING OPERATIVE CONTROLS

CROSS-REFERENCES TO RELATED APPLICATIONS

This application claims the benefit of U.S. Provisional Application No. 62/094,898, filed on Dec. 19, 2014, which is incorporated by reference herein.

BACKGROUND

The invention relates to a bar gun with dispensing buttons having the capability to remotely operate dispensing devices. Particularly, the invention relates to a bar gun having active and remote buttons with a sensor configuration connected to the buttons that can sense when a button is depressed to in turn operate dispensing devices that are located remotely from the bar gun body, to dispense a beverage component from the bar gun.

Beverage dispensing systems are commonly used in a wide variety of locales, including restaurants, snack bars, convenience stores, movie theaters, and any business where beverages are served. These beverage dispensing systems often dispense a variety of beverages of differing types and flavors, such as flavored carbonated sodas, iced tea, water, or even alcoholic beverages. These devices dispense the variety of beverages either by dispensing a single component beverage or by utilizing a dispensing array, also referred to as a diffuser, through which a single beverage may pass or a base beverage and a beverage additive, flow to a dispense point that facilitates discharge of beverages or beverage additives. The beverage components are then dispensed through a dispensing nozzle into a beverage container.

Some beverage dispensing systems are in the form of a beverage tower while others use a hand-held beverage dispensing handle, commonly referred to as a bar gun. The bar gun uses a single nozzle for dispensing multiple different beverages depending on the needs of the end user. A tower system can have a single nozzle or multiple nozzles for dispensing a beverage. When a single nozzle tower is used, it can be configured to dispense a variety of different beverages using valves in connection with a manifold and system of fluid lines connected to beverage sources for distributing a mixed or single component beverage through a nozzle. Buttons can be used to activate the valves to control the flow of the beverage from the system. The same concept is used with bar guns except that the buttons and valves in conventional bar guns are located in the bar gun itself rather than in the beverage system, which is connected to, but separate from the bar gun. Beverage dispensers utilizing this concept have at least one button, and often numerous buttons, for controlling the dispensing of a single beverage component or multiple beverage components simultaneously.

Conventional bar guns that are configured to dispense a multiple beverage component beverage, such as cola, have multiple buttons each configured to dispense specific components for the beverage depending on the desired beverage. In the example of a cola, the mixed beverage has a soda base and a beverage additive, which is the cola flavoring. There is a soda button, for when an operator desires to dispense only soda that is configured to operate a valve connected to fluid lines within the bar gun to dispense only the soda component. The bar gun has another button for dispensing cola that is configured, by way of a device called a butterfly plate, such that when the cola button is depressed it activates a valve connected to a cola fluid line as well as the valve connected to the soda fluid line so that only the cola button need be depressed, but both the cola additive and the soda base valves are opened to dispense a mixed cola beverage. In the conventional bar gun all the valves for dispensing the beverage components are located in the bar gun handle itself and mechanically connected to the bar gun buttons. This configuration however makes it so only two beverage components can be dispensed at a time.

Some desired beverages may contain more than two beverage components. For example, a consumer may order a cherry or vanilla flavored cola that currently cannot be dispensed with a conventional bar gun without previously mixing the vanilla or cherry with the cola additive and thus requiring all cola beverages to have this added flavor.

BRIEF SUMMARY OF THE INVENTION

Accordingly, it is desirable to develop a bar gun that can dispense additional beverage components to allow for a wider variety of beverages that can be customized and dispensed from a bar gun.

Some embodiments of the present invention relate to a beverage dispensing apparatus having a nozzle and multiple fluid lines in fluid communication with the nozzle where the beverage dispensing apparatus has a body with a plurality of apertures, a plurality of buttons, each protruding through a respective one of the apertures and configured to control a flow of fluid through a respective one of the multiple fluid lines, the plurality of buttons having at least one active dispensing button configured to mechanically dispense a fluid and at least one remote dispensing button, and a remote dispensing device located remotely from the body and configured to regulate dispensing a fluid through one of the multiple fluid lines, such that when the at least one remote button is depressed, the remote dispensing device dispenses a fluid through the fluid line.

Some embodiments include a sensing assembly configured to sense the depression of the at least one remote dispensing button. Some embodiments include a controller configured to receive a signal from the sensing assembly indicating when the at least one remote button has been depressed. In some embodiments, the sensing assembly includes a sensing element disposed to the at least one button, and a sensor disposed to the body and aligned with a respective sensing element, where when the remote button is depressed, the respective sensor interacts with its respective sensing element to sense that the remote button is depressed.

In some embodiments, the controller is configured to operate the remote dispensing device to dispense a fluid when the remote button is depressed. In some embodiments, the remote dispensing device is a solenoid valve. In some embodiments, the remote dispensing device is a solenoid pump.

Further understanding of the nature and the advantages of the embodiments disclosed and suggested herein may be realized by reference to the remaining portions of the specification and the attached drawings.

DETAILED DESCRIPTION OF THE INVENTION

Hand held beverage dispensers, which allow an operator to dispense a number of different beverages by merely pressing an appropriate button on the dispenser, have been around for many years. One exemplary bar gun is as described in Applicant's pioneering patent, U.S. Pat. No. 4,986,449 to Valiyee, the entirety of which is incorporated herein by reference. An exemplary tower is described in Applicant's patent application, U.S. Application No. US2011/0315711 A1 to Hecht. Other similar bar guns and towers are commercially available from Automatic Bar Controls at www.wunderbar.com.

Figure 1:
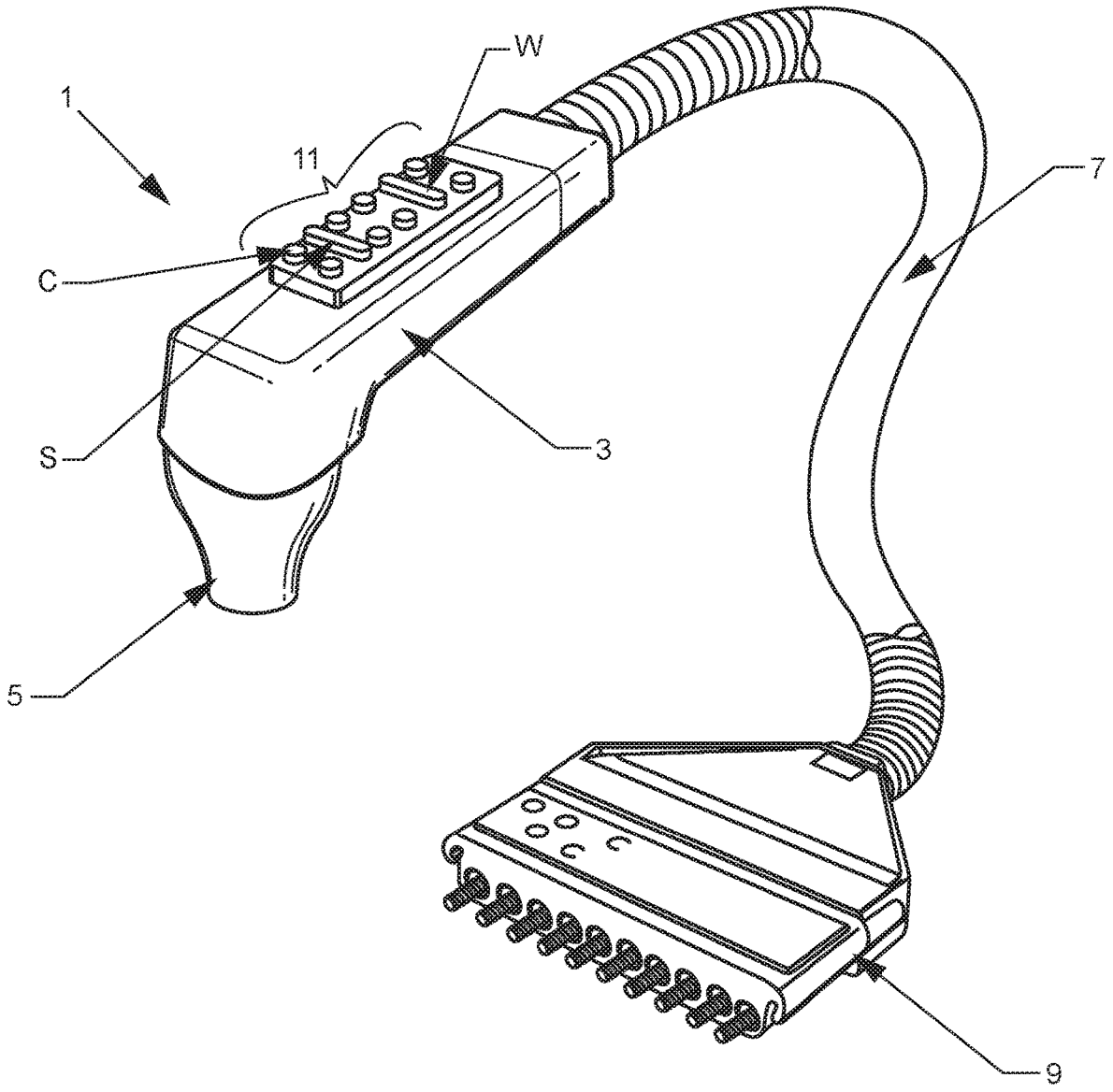
FIG. 1 (PRIOR ART)
FIG. 1 illustrates a conventional bar gun handle beverage dispensing apparatus.

Regarding a bar gun, as seen in Valiyee and illustrated in FIG. 1 the bar gun 1 has a handle 3 that has a nozzle 5 at one end for dispensing the beverage. At the other end, the handle 3 is connected to a flexible line 7 that connects to a brixing device 9 that contains shut off and flow valves for controlling the flow of beverage components to the bar gun. The brixing device 9 is in turn connected to a beverage source (not shown). The bar gun, also has buttons 11 on the handle 3 that activate valves inside the handle 3 for dispensing a single beverage component or a mixed beverage solution depending on the button 11 pushed by the operator and the configuration of the bar gun 1. Beverage dispensing towers can be configured similarly with a nozzle, a tower, dispensing and flow control valves and buttons for dispensing the beverage, except the buttons are installed on the fixed tower assembly rather than on the handle of a hand held bar gun.

The buttons on a bar gun handle or a tower beverage dispenser allow an operator to select particular beverage components and/or dispense the beverage components in predetermined or customizable flow rates and volumes. These buttons can be numerous, or merely be a single button, depending on the intend use of the operator or establishment utilizing the bar gun or tower. In the conventional bar gun, beverage dispensing valves, operable by the buttons, are located within the bar gun handle and are directly beneath the button such that when a button is depressed, the valve is actuated and a beverage fluid is dispensed.

In the conventional bar gun a soda button S and water button W can be depressed to dispense only soda or water, respectively. When either the soda button S or the water button W is depressed, they directly activate the soda and water valves located in the bar gun to dispense the selected fluid. In the circumstance where an operator wants to dispense cola, for example, the operator would depressed the cola button C, which mechanically activates both a cola valve and the soda valve. The cola button C is located adjacent the soda button S to allow the depressing of the cola button C to mechanically depressed both buttons, using a mechanical device referred to as a butterfly plate inside the bar gun which is described in detail in Valiyee.

Other dual component beverages can be dispensed with either a soda base or water base by configuring the buttons surrounding the soda button S and water button W to dispense the water and/or soda base with a beverage additive. Such beverages can include, root beer, lemon-lime soda, ginger ale and other kinds of beverages or even cocktails. Given the necessity that the cola button C, be located adjacent the soda button S, as described in the example above, beverages with more than two beverage components, such as a vanilla flavored cola, which has a soda base, cola syrup and a vanilla flavoring shot, are not possible in the conventional bar gun.

Embodiments in accordance with the present invention provide a mechanism for sensing and monitoring the depressing of a bar gun button for dispensing of a beverage or beverage component from a beverage dispenser like a bar gun where a remote dispensing device that can be a valve, pump or actuator or similar regulating device, that regulates the dispensing of the a fluid, is not located in the bar gun handle underneath the button, but instead at a remote location from the bar gun handle.

Figure 2:
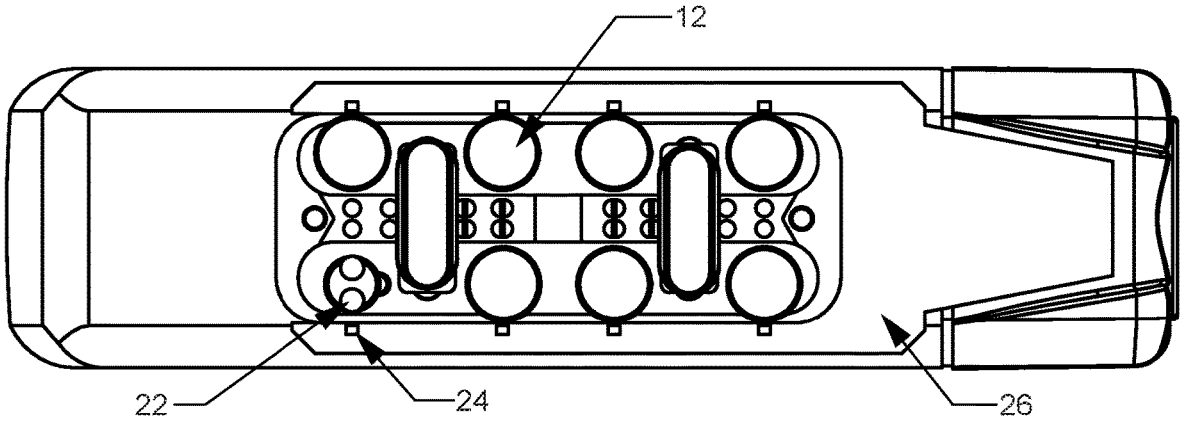
FIG. 2 illustrates one type of a bar gun with a sensing assembly in accordance with provisional application No. 62/044,144.
Figure 3:
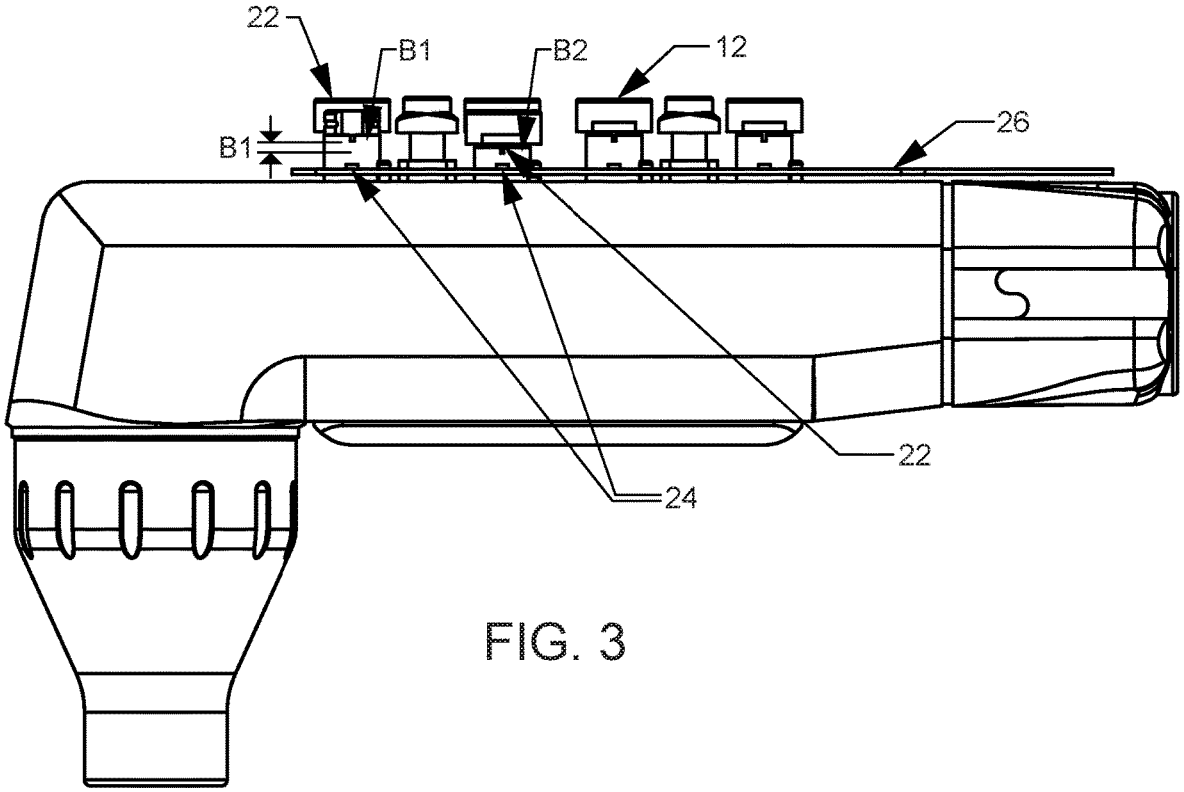
FIG. 3 illustrates an alternative view of the bar gun with a sensing assembly of FIG. 2.

Sensing and monitoring of the button can be provided in any number of ways. One such manner of sensing the depressing of the remote button can be done is by way of a sensing assembly in accordance with Applicants provisional application, U.S. Application No. 62/044,144, which is incorporated herein in its entirety and briefly described as follows in connection with FIG. 2 and FIG. 3. Sensing occurs when a magnet installed in the bar gun button is located within a particular distance of a sensor on a sensor plate. The sensor and magnet can be controlled to send a signal to an "intelligence" system that can record when a button has been depressed. The sensing assemblies can be magnetic sensors, such as Hall-Effect or reed sensors, among others, which positionally detect corresponding magnets coupled to the individual buttons of the bar gun. The type of sensor, cooperating magnet and relative positions between the sensor and magnet can be configured so that detection of the button activation i.e. travel, can be accurately sensed and determined to be "inactive" (not dispensing) or "active" (dispensing a beverage) even with a rather small change in the position of the magnet being monitored by the sensors. Other types of sensing of the dispensing of the flow are possible with various kinds of sensing methods including, the sensing of the position of the sensing element and buttons, as described here, as well as optically sensing the button movement or even optically.

The support circuitry for the sensing of the depressing of the remote button may be either simple and directly wired to a suitable monitoring circuit, or completely self-contained with the ability to transmit activation data to a system such as can be used for monitoring the activity of a venue such as a bar or restaurant. This support circuitry can also be interfaced via the monitoring circuit (or directly) to device driving means (with associated programming if desired) to activate one or more remote devices such as solenoids controlling the dispensing of beverage additives (described in greater detail below).

A controller can be connected to the sensing assembly that can detect motion of the button and can operate the remote dispensing devices. The signal from the sensing assembly can be in the form of a 4-20 mA current and can be transmitted to a current measuring device. The current measuring device may be part of the direct support circuitry of the sensing assembly or a self-contained unit with the ability to transmit data to a system, such as Skyflo®. Other configurations for measuring, collecting and transmitting the current information are also possible.

The above aspects of the invention can be further understood with reference to the exemplary devices shown in FIGS. 4-7, although the invention is not limited to the depicted embodiments and may include many variations in accordance with the principles and aspects described herein.

Figure 4:
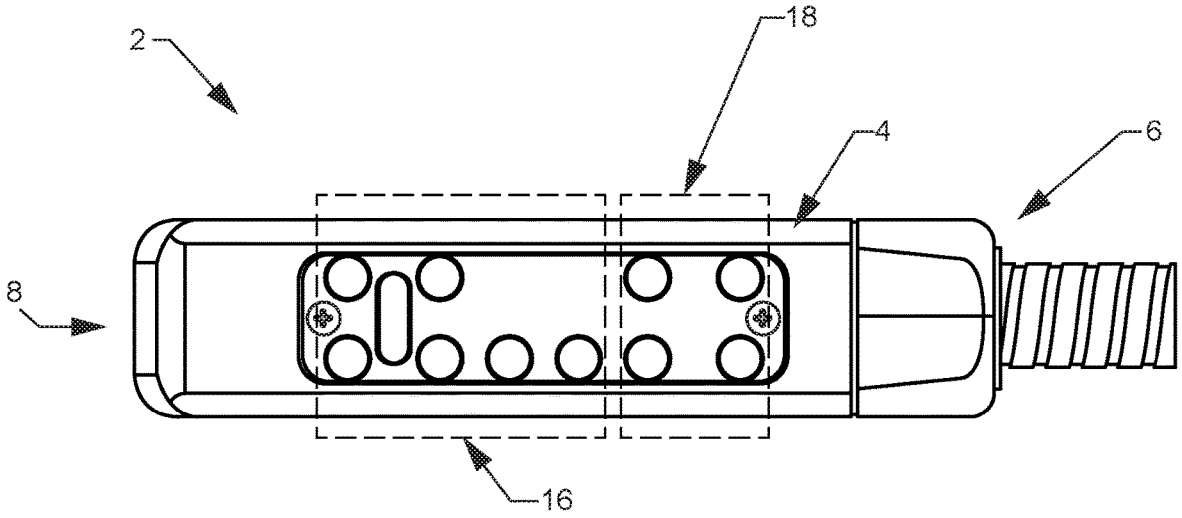
FIG. 4 illustrates a top view of a bar gun in accordance with one embodiment of the present invention.
Figure 5:
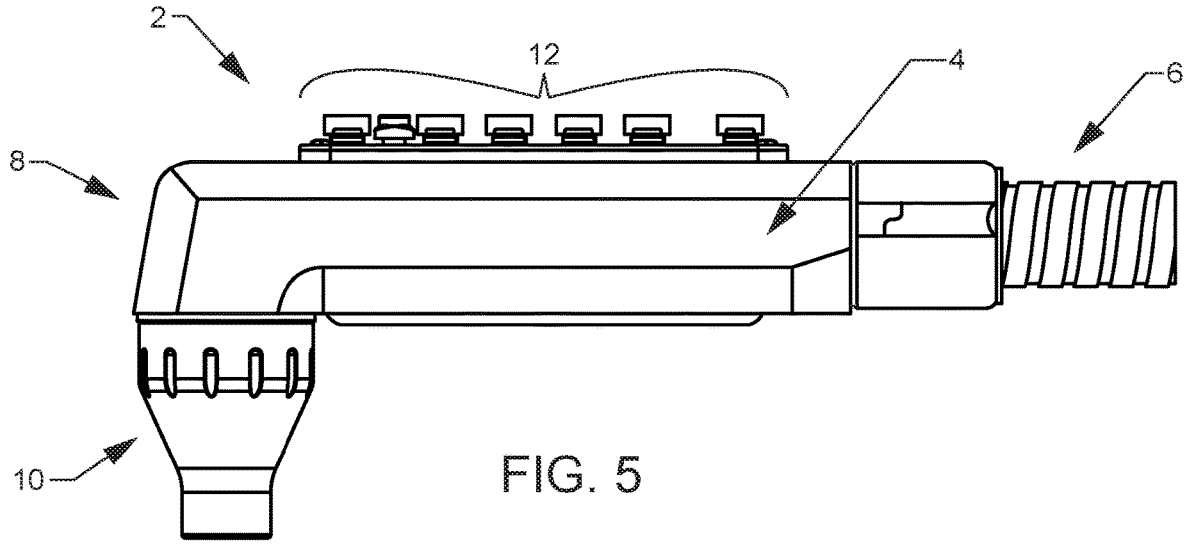
FIG. 5 illustrates a side view of the bar gun of FIG. 4.

FIG. 4 and FIG. 5. shows a top and side view, respectively, of a bar gun in accordance with one embodiment of the present invention. The bar gun 2 has a body 4 that extends from a back end 6 to a front end 8. Under the front end 8, a nozzle 10 extends from the body 4 for dispensing a beverage component into a suitable container (not shown). On the top side of the body 4 ten buttons 12 protrude up through the body 4. There are two distinct sets of buttons including an array of active buttons 16 which are configured in the same way buttons of a conventional bar gun. A second array of buttons includes remote activation buttons 18. The remote buttons 18 are located at the back end of the body and are not located adjacent a soda or water button.

Figure 6:
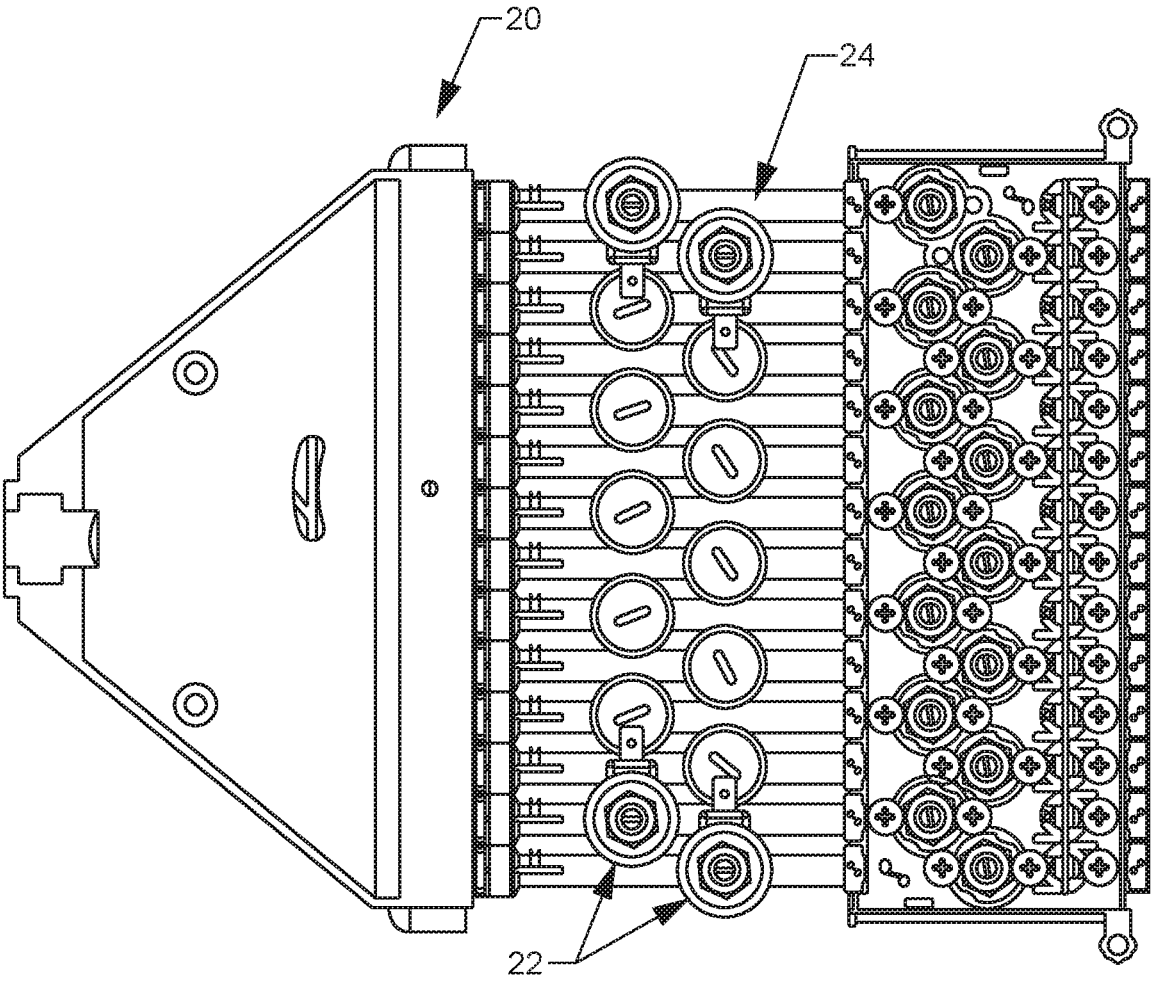
FIG. 6 illustrates a top view of remote dispensing devices and brixing apparatus in accordance with one embodiment of the present invention.
Figure 7:
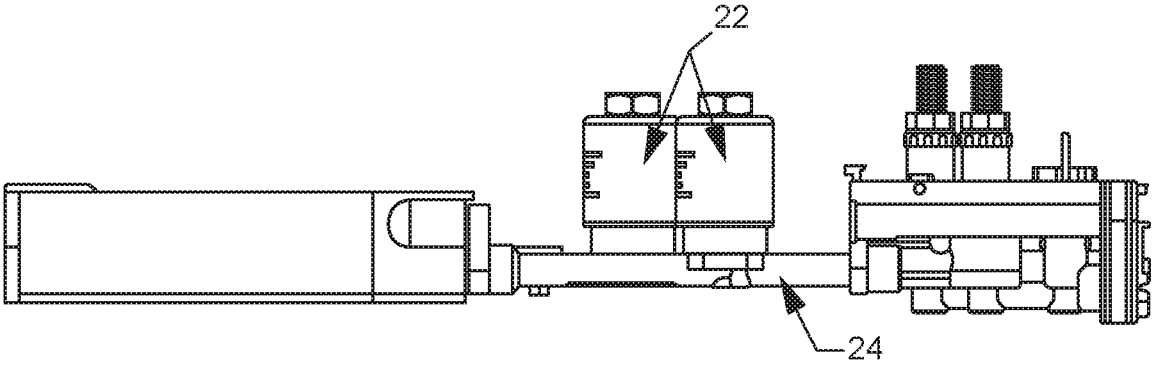
FIG. 7 illustrates a side view of the remote dispensing devices and brixing apparatus of FIG. 6.
Figure 8:
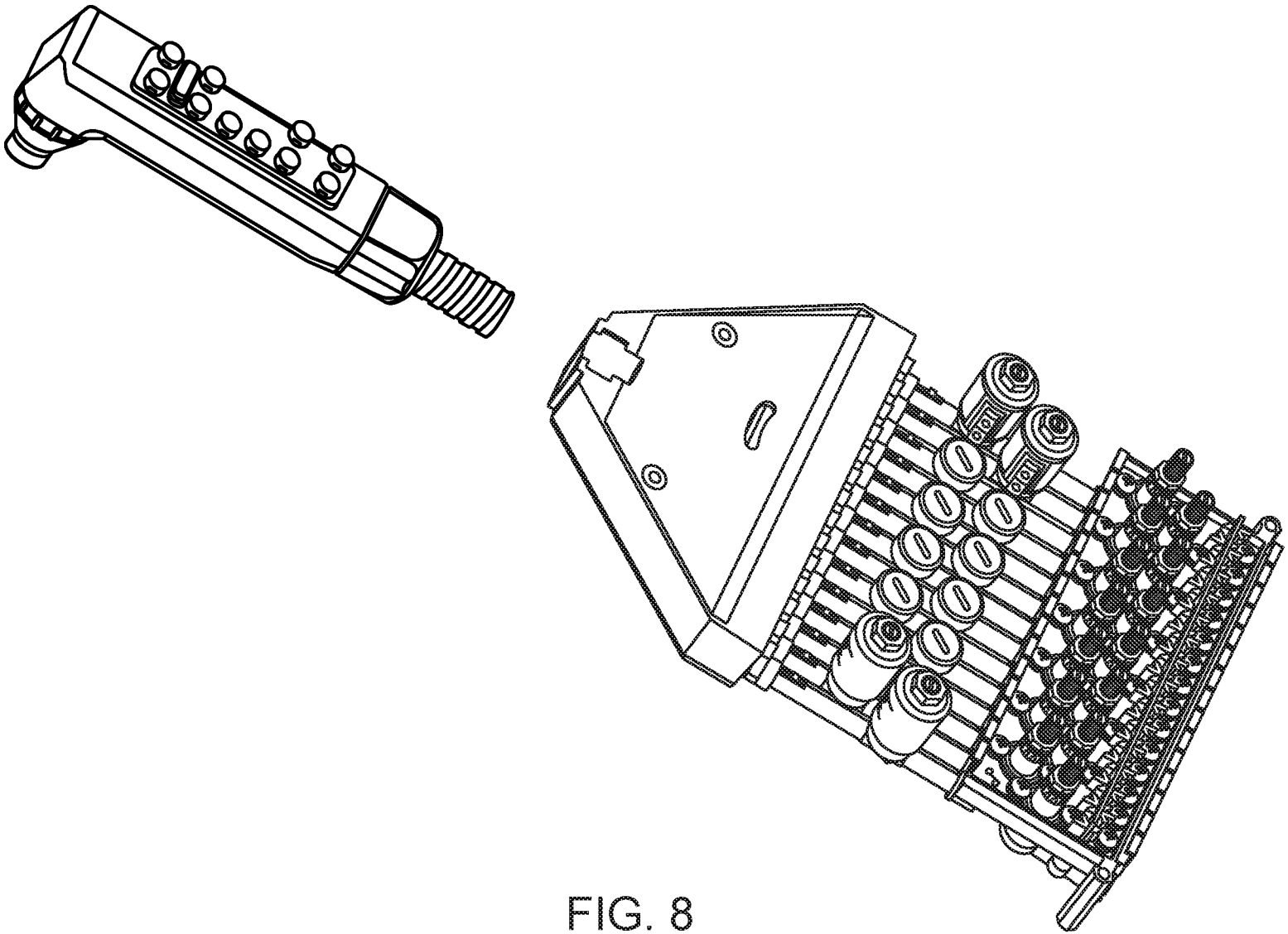
FIG. 8 illustrates a perspective view of the combined bar gun and remote dispensing devices with brixing apparatus of FIGS. 4-7.

The buttons of the active button array are connected with valves (not shown) inside the body 4, which work in connection with the brixing device 20, shown and in FIG. 6 and FIG. 7, for dispensing a beverage component when a button is depressed. A soda button S, dispenses Soda and a cola button C is configured to dispense Cola in the manner previously described in the conventional bar gun. The other soda based buttons CI, CII and CIII can all configured to dispense varying soda based beverages.

The remote buttons 18 are not directly connected to valves in the bar gun body 2 and thus do not directly mechanically actuate a fluid dispensing valve. Instead, a sensing assembly is connected to the button that can sense when one of the remote button is depressed. In some embodiments, a conventional bar gun can be retrofitted such that the valve beneath a button can be replaced with a "bypass" device that functions as though the valve was permanently "open" so that the remote device can actuate at the appropriate time. The fluid channels within the bar gun handle can also be configured as dedicated fluid paths that do not have the added expense of being machined for valves or bypass devices.

Figure 9:
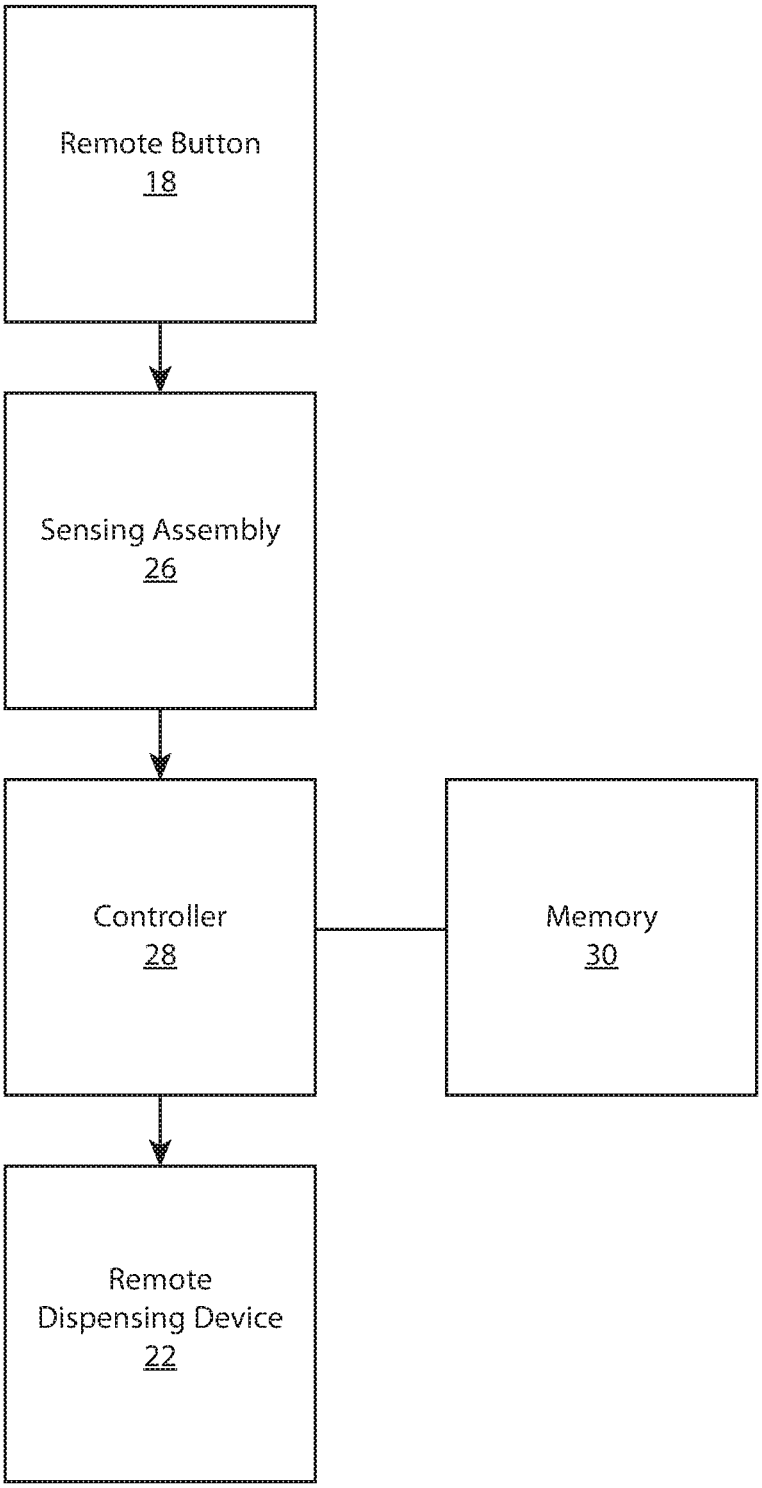
FIG. 9 shows a diagram of the remote operation of the remote dispensing device in accordance with one embodiment of the present invention.

FIG. 9 shows a diagram of one embodiment of the remote dispensing operation in accordance with the present invention. When a remote button 18 is depressed the sensing assembly 26 detects button being depressed and sends a signal to the controller 28. The controller 28 sends a signal to the remote dispensing device 22 shown in FIG. 6 and FIG. 7 to operate to dispense the requisite fluid. The controller 28, remote buttons 18 and sensing assembly 26 can be configured in various manners. In some embodiments, the remote buttons 18 can be toggle buttons, where when a button is depressed the button can mechanically be toggled. The controller 28 can also store in a memory an operation mode where the remote dispensing device 22 dispenses a fluid whenever one of the other beverage buttons, such as the cola button C is depressed, thereby adding a flavor shot to the dispensed beverage.

In some embodiments the controller 28 can be configured to store a control signal to dispense a fluid from the remote device when a remote button is depressed to have a time out feature. This can be configured in short duration increments, for example for 3 or 5 seconds. This can be done to avoid the circumstance where one of the buttons might accidentally be bumped during operation by an operator, but a flavor additive is not desired to be dispensed with a beverage. In such a case, the time out feature would prevent accidental dispensing of an undesired beverage components, which can lead to less waste due to throwing out undesired beverages.

In operation when an operator desires to dispense a flavor enhanced beverage, such as cola with a vanilla flavoring, the operator can press a remote button 18, like the vanilla flavor button V. The other flavor additive buttons VI, VII and VIII, all included in the remote button array 18, can all be configured to dispense varying flavor components for beverages. These flavor components can include all types of fluids or such as mixers for cocktails, in addition to the flavor additives described herein. This action is sensed by the sensing assembly 26 and a signal is transmitted to the controller 28. Then the operator can subsequently press the cola button C. The controller can be configured such that when the cola button C is depressed, the controller operates the remote dispensing device 22 to dispense the vanilla flavor component through the fluid line 24. Simultaneously, the cola button C mechanically actuates the dispensing valves in the bar gun body 2 for the soda and cola as described above. All of the fluid streams, includes the base (soda), syrup (cola) and flavor (vanilla) all exit the bar gun at the dispensing ports at the front end 4 of the bar gun and mix in the nozzle 10 to ultimately be dispensed into a suitable container.

This sensing and remote operation increases the utility of bar guns in that conventionally the actuation of a single button on bar gun provided only the basic beverage such as a cola or root beer, a bar gun in accordance with the present invention can now add one or more flavor additions (either as portion controlled "shots" or continuously pour) during the dispensing of the selected beverage. This functionality can be further enhanced to provide individual flavor additives (shots) for use in beverage types not dispensed by the bar gun such as the flavoring of cocktails.

The above description is illustrative and is not restrictive. A recitation of "a", "an" or "the" is intended to mean "one or more" unless specifically indicated to the contrary. Many variations of the disclosure will become apparent to those skilled in the art upon review of the disclosure. One or more features from any embodiment described herein may be combined with one or more features of any other embodiment without departing from the scope of the disclosure. The scope of the disclosure should, therefore, be determined not with reference to the above description, but instead should be determined with reference to the pending claims along with their full scope or equivalents.

What is claimed is:

1. A beverage dispensing system comprising:

a flexible line containing multiple fluid lines;

a remote dispensing device coupled to a first end of the flexible line and configured to dispense a first fluid through a first fluid line of the multiple fluid lines;

a bar gun coupled to a second end of the flexible line, opposite the first end of the flexible line, the bar gun comprising:

a body having a plurality of apertures;

a nozzle;

a plurality of buttons, each protruding through a respective one of the apertures, the plurality of buttons comprising an active dispensing button configured to directly mechanically actuate a valve within the body to dispense a second fluid from a second fluid line of the multiple fluid lines, and a remote dispensing button; and a sensing assembly configured to sense depressions of the active dispensing button and to sense depression of the remote dispensing button; and a controller configured to actuate the remote dispensing device to dispense the first fluid through the nozzle in response to initially receiving a first signal from the sensing assembly indicating the remote dispensing button has been depressed and subsequently receiving a second signal from the sensing assembly indicating that the active dispensing button is depressed and is directly mechanically actuating the valve so that the second fluid is being dispensed from the nozzle.

2. The beverage dispensing apparatus of claim 1 wherein the sensing assembly comprises:

a sensing element disposed on the active dispensing button; and a sensor disposed on the body and aligned with the sensing element, wherein when the active dispensing button is depressed to directly mechanically actuate the valve the sensor interacts with the sensing element to sense that the active dispensing button is depressed.

3. The beverage dispensing apparatus of claim 1, wherein the remote dispensing device is a solenoid valve.

4. The beverage dispensing apparatus of claim 1, wherein the remote dispensing device is a solenoid pump.

5. The beverage dispensing apparatus of claim 1, wherein the active dispensing button is configured to directly mechanically actuate a second valve within the body to dispense a third fluid from a third fluid line of the multiple fluid lines, and wherein the first, second, and third fluids are dispensed through the first valve, second valve, and remote dispensing device, in response to initially receiving a first signal from the sensing assembly indicating the remote dispensing button has been depressed and subsequently receiving a second signal from the sensing assembly indicating that the active dispensing button is depressed and is directly mechanically actuating the valve and the second valve.

* * * * *